US008915204B2

(12) United States Patent
Forrester

(10) Patent No.: US 8,915,204 B2
(45) Date of Patent: Dec. 23, 2014

(54) SAIL MOUNTING ASSEMBLY

(76) Inventor: Patrick W. Forrester, Perrysburg, OH (US)

( * ) Notice: Subject to any disclaimer, the term of this patent is extended or adjusted under 35 U.S.C. 154(b) by 125 days.

(21) Appl. No.: 13/482,602

(22) Filed: May 29, 2012

(65) Prior Publication Data

US 2012/0298026 A1 Nov. 29, 2012

Related U.S. Application Data

(60) Provisional application No. 61/490,941, filed on May 27, 2011.

(51) Int. Cl.

| | |
|---|---|
| ***B63B 15/00*** | (2006.01) |
| ***B63B 3/52*** | (2006.01) |
| ***B63H 9/10*** | (2006.01) |
| *B63B 15/02* | (2006.01) |

(52) U.S. Cl.

CPC ..... *B63H 9/10* (2013.01); *B63B 15/0083* (2013.01); *B63B 2221/22* (2013.01); *B63B 15/02* (2013.01); *B63B 2221/00* (2013.01); *B63B 2015/0016* (2013.01); *B63B 3/52* (2013.01); *B63B 2015/005* (2013.01)

USPC ..... 114/90; 144/93

(58) Field of Classification Search

USPC ..... 114/94, 101, 90, 93, 91

See application file for complete search history.

(56) References Cited

U.S. PATENT DOCUMENTS

| | | | | |
|---|---|---|---|---|
| 382,620 | A * | 5/1888 | Rees | 114/83 |
| 4,230,060 | A * | 10/1980 | McCoy | 114/39.31 |
| 4,236,476 | A | 12/1980 | Solf et al. | |
| 4,291,639 | A * | 9/1981 | Burdick | 114/90 |
| 4,838,189 | A * | 6/1989 | Kurhi | 114/39.12 |
| 4,993,339 | A * | 2/1991 | Cooper et al. | 114/39.17 |
| 6,554,254 | B2 * | 4/2003 | Vetesnik | 254/325 |
| 7,350,474 | B2 | 4/2008 | Horiuchi | |

* cited by examiner

*Primary Examiner* — Stephen Avila

(74) *Attorney, Agent, or Firm* — MacMillan, Sobanski & Todd, LLC

(57) ABSTRACT

A mast assembly for a sailing vessel includes a first tubular portion defining an interior and an end, and a second tubular portion defining an interior and an end. The mast assembly also includes a ferrule having a first end disposed within the interior of the first tubular portion, and a second end disposed within the interior of the second tubular portion. An intersection ring is disposed over the ferrule and positioned between the ends of the first and second tubular portions. The intersection ring includes a plurality of apertures formed therein for receiving rigging lines.

20 Claims, 16 Drawing Sheets

SAIL MOUNTING ASSEMBLY

CROSS-REFERENCE TO RELATED APPLICATIONS

This application claims the benefit of U.S. Provisional Application No. 61/490,941, filed on May 27, 2011, the disclosure of which is incorporated herein by reference.

BACKGROUND OF THE INVENTION

This invention relates in general to sailing vessels and, in particular, to sail mounting assemblies that are well suited for smaller vessels, such as kayaks, canoes, sailing boards, and rowboats.

Kayaks and other smaller sailing vessels may come equipped with or without sailing assemblies. It is known to provide aftermarket sailing assemblies which can be attached and used with a kayak even though the kayak was originally not manufactured and provided with an integral sailing assembly. These sailing assemblies generally include a single triangular shaped sail which is supported by a generally vertical rigid mast and a horizontally extending boom. Various rigging lines, such as rope, cords or cables, are provided to fasten the sail to the mast and boom as well as control the position of the sail when in use. It is desirable to provide an inexpensive stable sail assembly which is easy to attach to the sailing vessel.

SUMMARY OF THE INVENTION

This invention relates to sail assemblies for a sailing vessel and various components of a sail assembly. One feature includes a mast assembly for a sailing vessel having a first tubular portion defining an interior and an end, and a second tubular portion defining an interior and an end. The mast assembly also includes a ferrule having a first end disposed within the interior of the first tubular portion, and a second end disposed within the interior of the second tubular portion. An intersection ring is disposed over the ferrule and positioned between the ends of the first and second tubular portions. The intersection ring includes a plurality of apertures formed therein for receiving rigging lines.

Another feature includes a mast coupling assembly for pivotally attaching a mast to a sailing vessel. The coupling assembly includes a mounting member adapted to be attached to a deck of a sailing vessel. The coupling assembly further includes a universal joint assembly having a first yoke, a second yoke, and a cross member. The first yoke has a body and a pair of spaced apart yoke arms extending from the body. The body is rotatably attached to the mounting member. The second yoke has a body and a pair of spaced apart yoke arms extending outwardly from the body of the second yoke. The body of the second yoke is adapted to be connected to an end of a mast. The cross member is pivotally attached to the yoke arms of the first and second yokes, wherein one of the bodies of the first and second yokes includes an aperture formed therethrough adapted to receive a rigging line.

Another feature includes a sail assembly having a sail defining a tack and a mast attached to the sail. The mast includes a first end a second end. A coupling assembly is pivotally attached to the second end of the mast. A coupling assembly is adapted to be mounted on a deck of a sailing vessel. A boom is attached to the mast at a connection point, wherein the connection point is adjacent the tack of the sail. A first fairlead is located between the connection point and the mounting assembly. A second fairlead is located on the mast between the first end of the mast and the connection point. A single flexible rigging line has a first end attached to the tack of the sail. The line extends from the tack to the first fairlead, and from the first fairlead to the second fairlead.

Yet another feature includes a mast step assembly having a mounting bracket for attachment to an underside of a deck and a mast step having a first end pivotally attached to the mounting bracket. The mast step has a second end adapted to engage a hull of the sailing vessel, wherein the mast step is movable between a retracted position such that the second end is not engaged with the hull, and a deployed position such that the second end is engageable with the hull.

Various aspects of this invention will become apparent to those skilled in the art from the following detailed description of the preferred embodiments, when read in light of the accompanying drawings.

DESCRIPTION OF THE PREFERRED EMBODIMENTS

Figure 1:
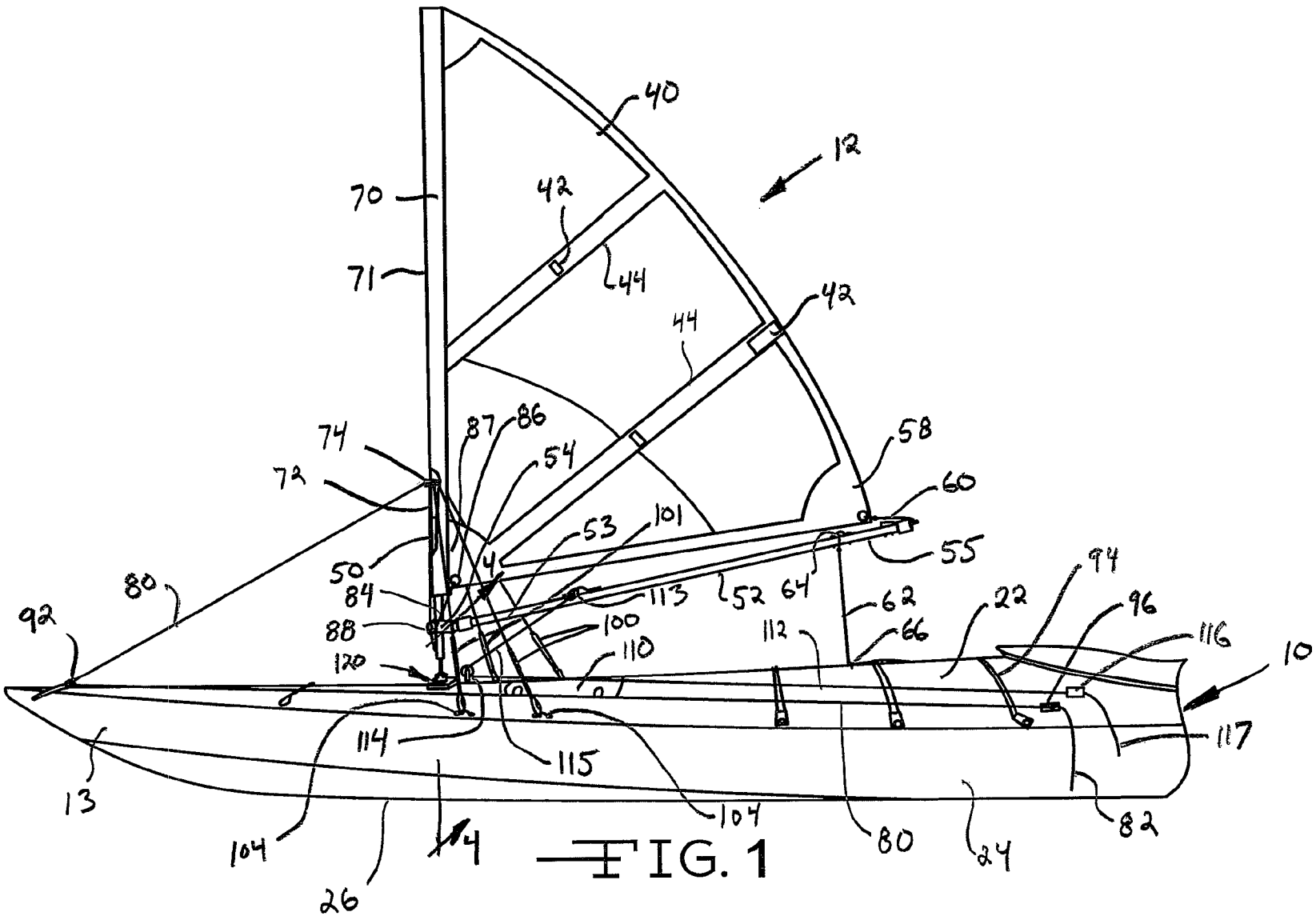
FIG. 1 is a side elevational view of a front portion of a kayak having a sail assembly mounted thereon, wherein the sail is in an upright position.

Referring now to the drawings, there is illustrated in FIG. 1 a kayak, indicated generally at 10, that includes a sail assembly, indicated generally at 12, mounted thereon. As will be explained below, the sail assembly 12 is removably mounted on the kayak 10 so that it can be installed and removed easily and quickly. It should be understood that the sail assembly 12 can be installed onto any suitable sailing vessel and that the kayak 10 illustrated in the drawings is just one example of suitable sailing vessel that the sail assembly 12 is mounted on. For example, the sail assembly 12 may be mounted on a canoe, a sailing board, a rowboat, or any other boating vessel.

Figure 2:
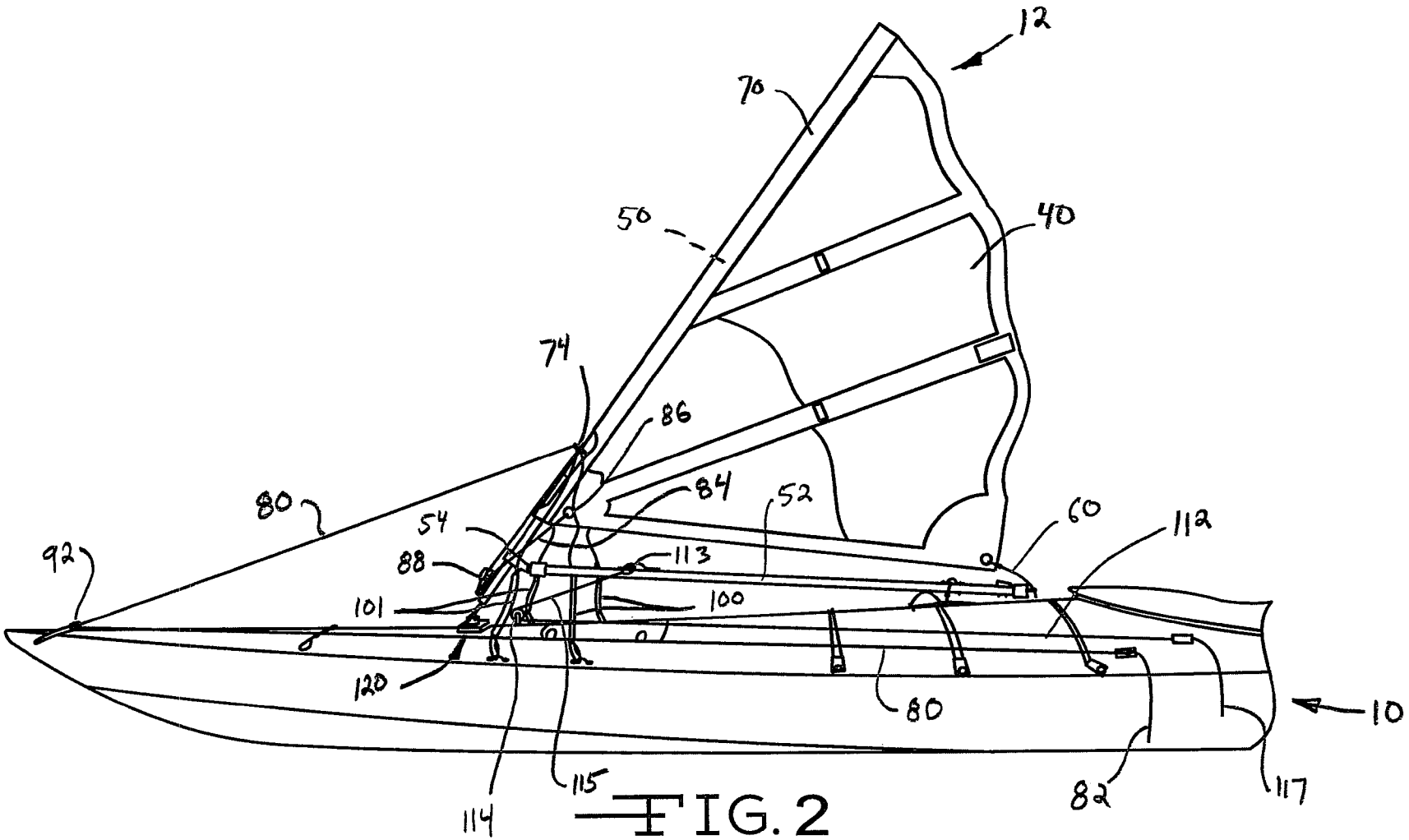
FIG. 2 is a side elevational view of the kayak of FIG. 1, wherein the sail is in a partially released position.
Figure 3:
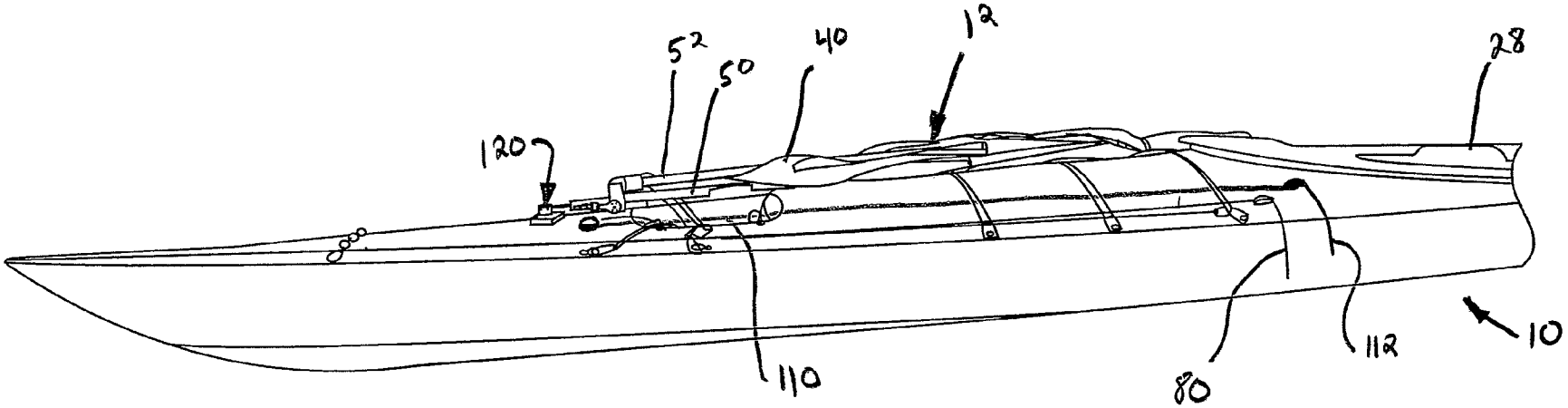
FIG. 3 is a side elevational view of the kayak of FIG. 1, wherein the sail is in a fully released and retracted position on top of the deck of the kayak.
Figure 4:
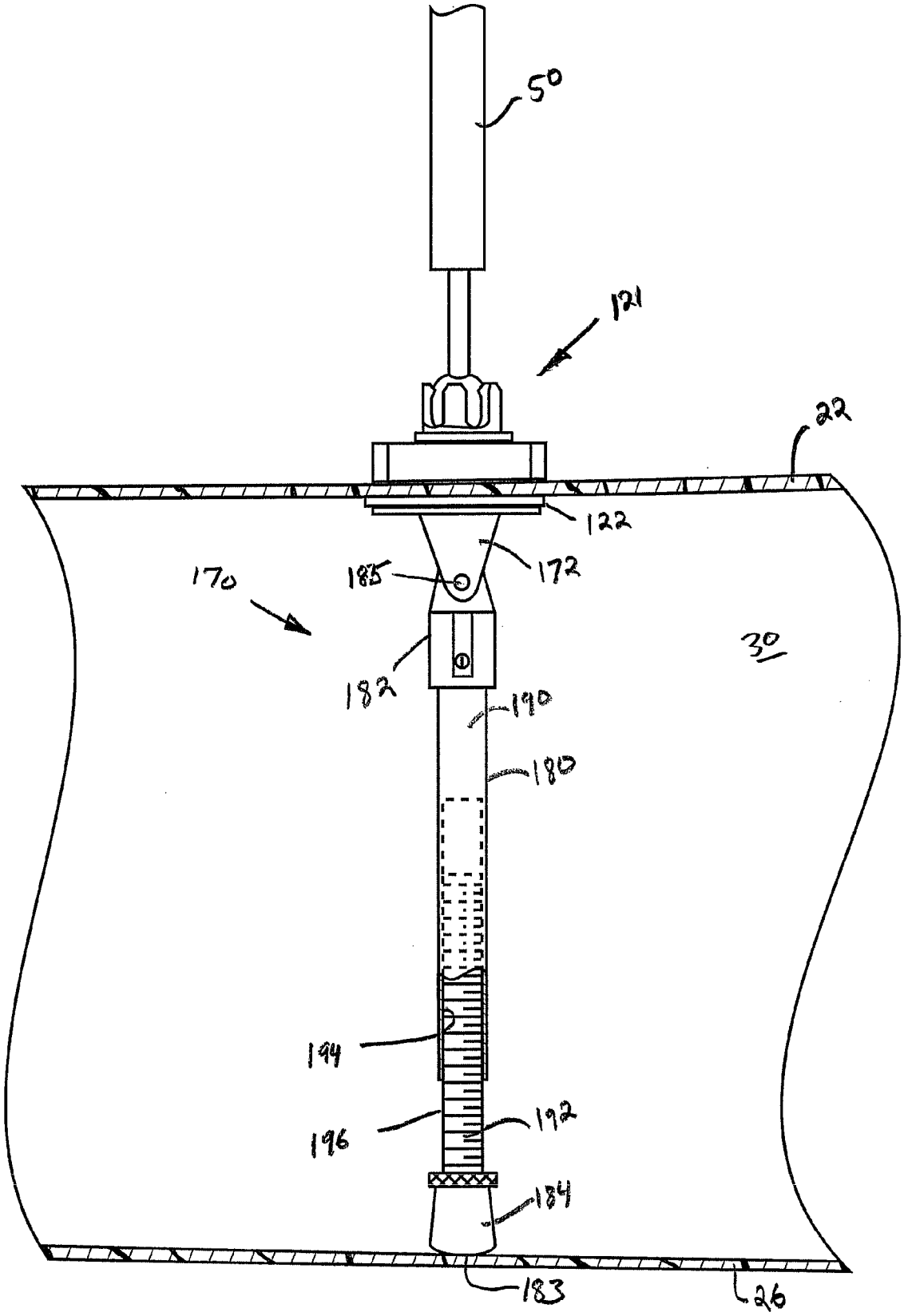
FIG. 4 is a partial cross-sectional view through the hull of the kayak taken along lines 4-4 in FIG. 1 illustrating the mast step assembly, wherein the support member of the mast step assembly is in a deployed position.

The kayak 10 includes a deck 22, sides 24, and a bottom or hull 26. The deck 22, sides 24, and hull 26 define an interior or cavity 30, as seen in FIG. 4. Note that FIGS. 1 through 3 generally show a front portion of the kayak 10 with an aft portion of the kayak 10 omitted from the drawings. As shown in FIG. 3, the kayak 10 has a cockpit or opening 28. During use of the kayak 10, the upper body portion of a sailor (not shown) extends through the opening 28. The sailor's legs and lower body are disposed in the cavity 30 of the kayak 10 underneath the opening 28. Of course, the kayak 10 may be configured as a "sit on top" design which may not have an interior cavity formed therein and the sailor merely sits at a cockpit area formed on the upper surface of the kayak. The sailor is able to manipulate and control the sail assembly 12 with various lines or rigging (ropes, cables, or chains), as will be described in detail below. The illustrated kayak 10 includes an optional covered hatch 110 (shown open in FIG. 3) to provide access to the cavity or interior of the kayak 10.

As shown in FIG. 1, the sail assembly 12 includes a generally triangular shaped sail 40. The sail 40 is flexible and may be made of any suitable material such as cloth or synthetic materials. The sail 40 may have one or more batons 42 retained in pockets 44 formed in the sail 40 to provide stiffness for portions of the sail 40. The sail assembly 12 further includes a vertically extending mast 50 and a generally horizontal boom 52 when the sail 40 is upright as shown in FIG. 1. The mast 50 and boom 52 may be formed from relatively rigid rods or tubes. For example, the mast 50 and boom 52 may be made of metal, fiberglass, or carbon fiber tubing. The rods or tubes may be circular or non-circular in cross-section. For example, the mast 50 may be made of a bar or strip having an oval or rectangular cross-sectional shape. The boom 52 may be separate from the sail 40, as shown in the drawings, or may integrally formed therein. A first end 53 of the boom 52 can be connected to the mast 50 via a collar 54 or other suitable connection. The collar 54 functions as a connection point of the boom 52 to the mast 50. The collar 54 may be in the form of a ring through which the mast 50 extends so that the boom 52 is slidably attached to the mast 50. In this configuration, the first end 53 of the boom 52 is able to move in a vertical direction along the length of the mast 50 to aid in raising and lowering the sail assembly 12. However, the boom 52 and the mast 50 may be connected by any suitable connection such as by pivoting, sliding, and/or a ball and socket type of connection.

Referring again to FIG. 1, a second end 55 of the boom 52 is attached to an aft bottom corner of the sail 40, commonly referred to as a clew 58, via an outhaul 60 which may include a cleat or other device for adjustably connecting the outhaul 60 to the sail 40. The clew 58 of the sail 40 is commonly referred to as the clew. The outhaul 60 may be a line which is tied or otherwise secured to the clew 58 of the sail 40 and the second end 55 of the boom 52. Additionally, a line or sheet 62 may be attached to the boom 52 or the sail 40, such as at a tie point 64. The sheet 62 may be inserted through one or more pad eyes 66 mounted on the deck 22. The pad eye 66 can be any suitable device mounted on the deck 22 which provides a line attachment point and/or permits a line to be run through it to function as a fairlead. A fairlead is any suitable device that guides a line, rope or cable around an object, out of the way or to stop it from moving laterally or vertically relative to the length of the line. Conventional fairleads are formed as rings or hooks through which a line extends and commonly bend or rerouted thereat. The sheet 62 extends through the pad eye 66 such that the sailor can pull on the sheet 62 to control the position of the second end 55 of the boom 52 which also provides tension on the sail 40.

The sail 40 may be attached to the mast 50 by any suitable manner. In the embodiment shown in FIG. 1, the sail 40 includes an elongated tubular pocket 70 formed on a forward leading edge 71 of the sail 40. The forward leading edge 71 of the sail 40 is commonly referred to as a luff. The pocket 70 forms a tubular cavity for receiving the mast 50, thereby connecting the edge 71 of the sail 40 to the mast 50. As shown in FIG. 1, the pocket 70 may include an opening 72 at a lower portion thereof to expose a ring shaped intersection ring 74 of the mast 50. As will be discussed in more detail below with respect to FIGS. 1 and 11, various lines and rigging (ropes, cords, etc.) are connected to the intersection ring 74.

Figure 12:
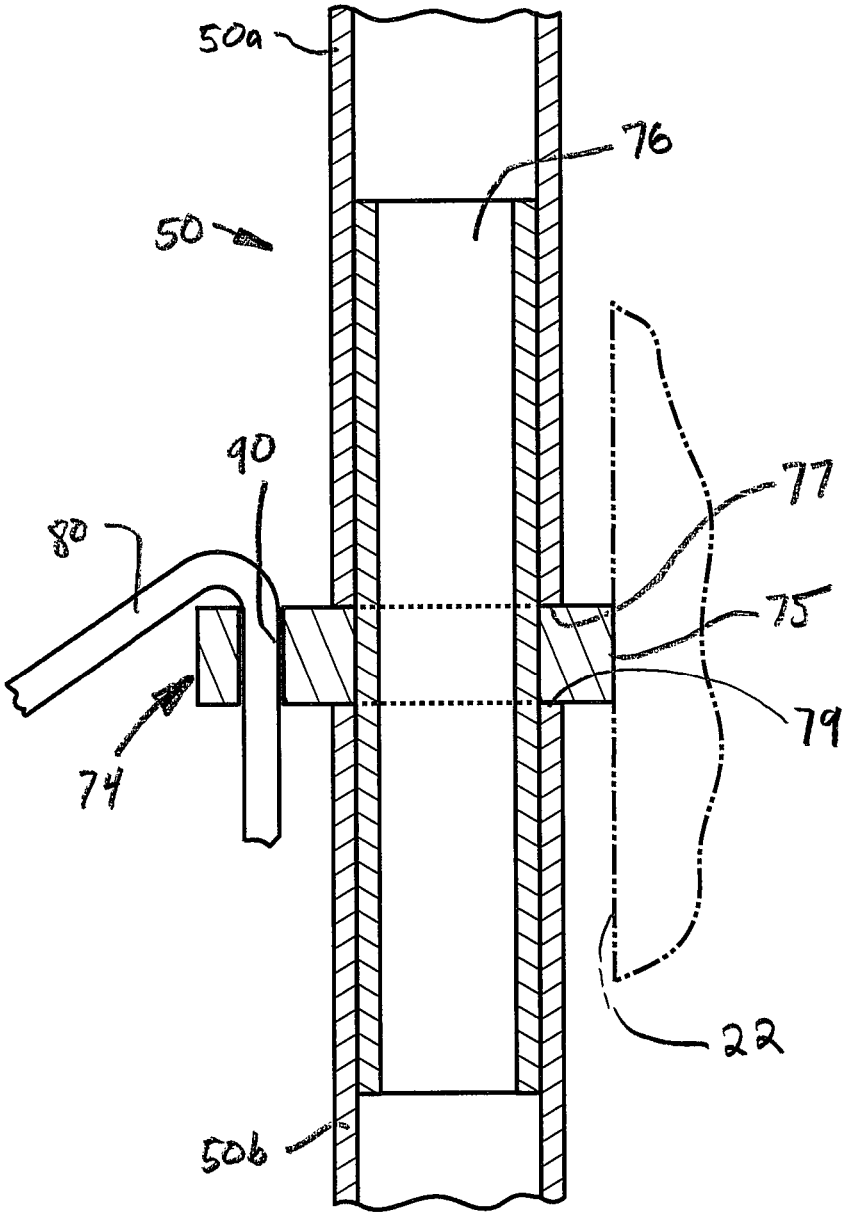
FIG. 12 is a cross-sectional view of the mast taken around the region of the intersection ring.

The mast 50 may be made of a single elongated part or may be made of two or more parts attached together. For example, as shown in FIG. 12, the mast 50 is made from an upper portion 50*a* and a lower portion 50*b* separate from one another. The upper and lower portions 50*a* and 50*b* are tubular and may have similar cross-sectional dimensions. For example, the upper and lower portions 50*a* and 50*b* have the same outer diameter dimension and inner diameter dimension. The upper and lower portions 50*a* and 50*b* may be made of any suitable material, such as carbon fiber, fiberglass, or any other suitable material. The upper and lower portions 50*a* and 50*b* are connected together by an inner sleeve or tubular ferrule 76. The ferrule 76 is disposed within and between the upper and lower portions 50*a* and 50*b* as shown in FIG. 12. The ferrule 76 may be adhered or otherwise attached to one of the upper and lower portions 50*a* and 50*b* such that the ferrule extends outwardly from an end of one of the upper and lower portions 50*a* and 50*b*. To assemble the mast 50, the other of the upper and lower portions 50*a* and 50*b* is simply slipped over the exposed portion of the ferrule 76. This configuration provides a quick and easy connection method to form the mast 50.

Additionally, as shown in FIG. 12, the intersection ring 74 may be sandwiched between ends 77 and 79 of the upper and lower portions 50*a* and 50*b*, respectively. The position of the intersection ring 74 along the length of the mast 50 is determined by the lengths of the upper and lower portions 50*a* and 50*b*. During assembly of the mast 50, the intersection ring 74 is inserted over the exposed portion of the ferrule 76 such that the edges 77 and 79 of the upper and lower portions 50*a* or 50*b* function as stops. The other portion 50*a* or 50*b* can then be inserted over the exposed end of the ferrule 76, thereby forming the mast 50 and fixing the intersection ring 76 at a desired position along the length of the mast 50. Although the ferrule 76 and the intersection ring 74 are shown as separate parts, it should be understood that they may be integrally formed together.

An advantage of not permanently mounting the intersection ring 74 to the mast 50 is that different rigging configurations can be easily replaced or changed by replacing the intersection ring 74 with one having different lengths of rigging lines connected thereto. For example, a single sail 40 may be used for two separate kayaks by having two sets of intersection rings 74 with appropriate lengths of forestays 80 and stays 100 attached thereto. Each kayak may have a portion of the coupling assembly 120 mounted thereon.

Figure 11:
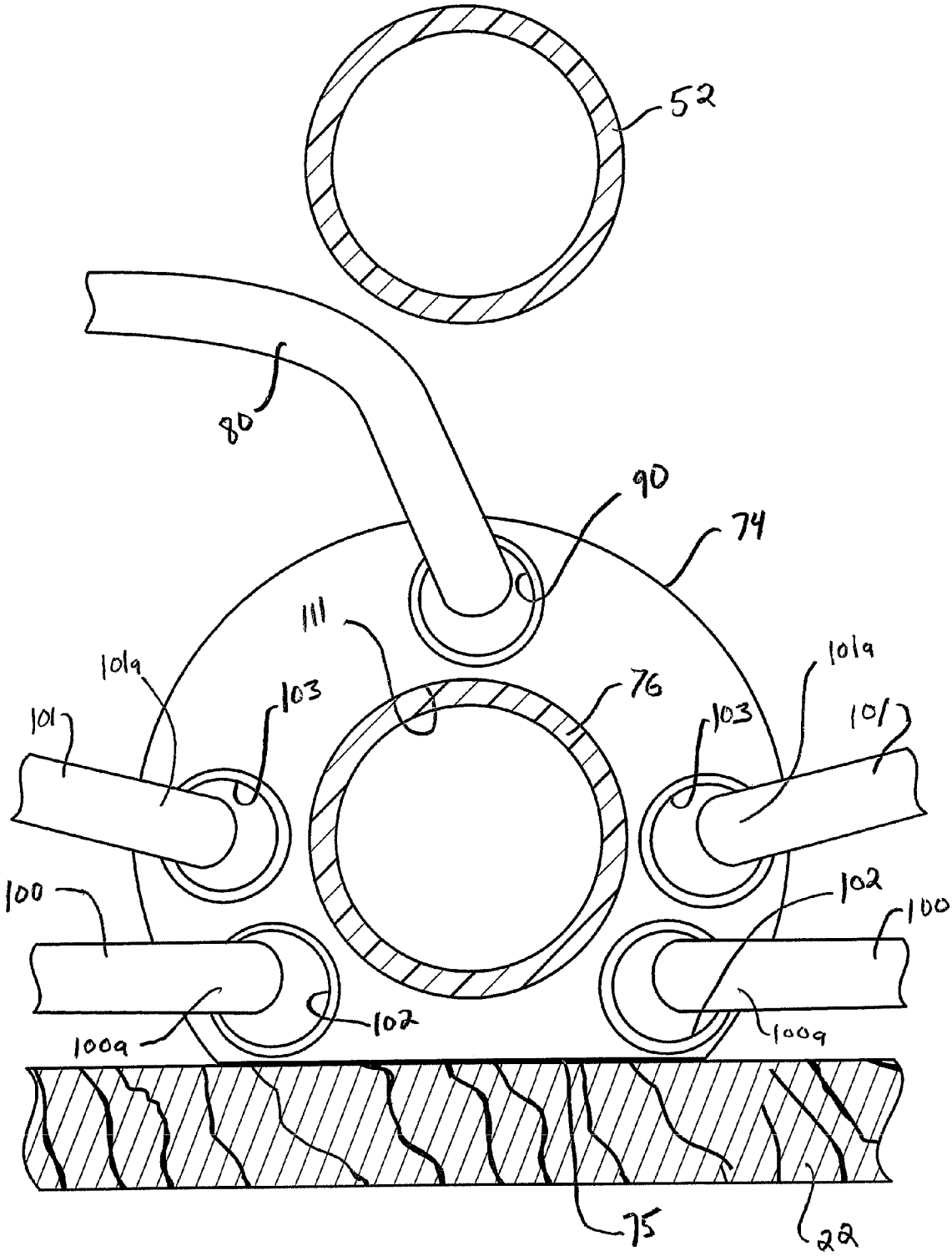
FIG. 11 is a partial cross-sectional view taken along lines 11-11 in FIG. 10.

Referring to FIG. 1, the sail assembly 12 further includes a line commonly referred to as a forestay 80 for generally keeping the sail 40 from falling in an aft direction, i.e., maintaining the sail in a generally upright position. Additionally, the forestay 80 also applies a downward force on the sail (similar to a separate downhaul in conventional sailing vessels). The sailor controls the position and tension of the forestay 80 by pulling or releasing a first end 82 of the forestay 80. The forestay 80 has a second end 84 which is connected to a front lower portion of the sail 40, commonly referred to as a tack 87, at an eyelet 86. From the eyelet 86, the forestay 80 is directed downwardly to a pulley 88 mounted on or adjacent to the mast 50. From the pulley 88, the forestay 80 is directed upwardly to the intersection ring 74. As shown in FIGS. 11 and 12, the intersection ring 74 includes a through hole 90 through which the forestay 80 extends. From the intersection ring 74, the forestay 80 is directed towards a bow 13 of the kayak 10 through a pulley 92. The pulley 92 can be attached to the bow 13 of the kayak 10 by any suitable manner. The forestay 80 is directed rearwardly from the pulley 92 to a cleat 96. The cleat 96 secures the first end 82 of the forestay 80 and provides for an anchoring point of the forestay 80. The cleat 96 may simply be a pad eye or hook such that the forestay is tied thereon. Preferably, the cleat 96 is a cam or jam cleat such that the forestay 80 is temporarily clamped and can be easily loosened when needed. In this configuration, the forestay 80 simultaneously provides two functions. The first function is applying a downward force on the tack 87 of the sail 40. The second function is keeping the sail 40 from falling in an aft direction to maintain the mast 50 in a generally vertical position.

The sail assembly 12 also includes one or more lines, commonly referred to as stays, for stabilizing the mast 50. In the illustrated embodiment of the sail assembly 12 shown in FIG. 1, there is a pair of back stays 100 mounted on either side of the deck 22 of the kayak 10. Slightly forward of the back stays 100 is a pair of side stays 101 mounted on either side of the deck 22. Lower ends of each of the stays 100 and 101 are connected to the deck 22 via corresponding pad eyes 104 mounted on the deck 22 of the kayak 10. Upper ends of the stays 100 and 101 are connected to the intersection ring 74. More specifically, as shown in FIG. 11, the back stays 100 include ends 100*a* which are inserted through holes 102 formed through the intersection ring 74. The ends 100*a* can be tied to the intersection ring 74 via the holes 102 or can include knots (not shown) formed on the ends 100*a* which are larger than the diameter of the holes 100*a* so that the knots will not slip through the holes 102. In a similar manner, the side stays 101 include ends 101*a* which are inserted through holes 103 formed through the intersection ring 74 and can include knots formed therein for securing the ends relative to the intersection ring 74. The ends of the holes 90, 102, and 103 may be chamfered to help prevent fraying of the forestay 80, the back stays 100 and the side stays 101.

Figure 10:
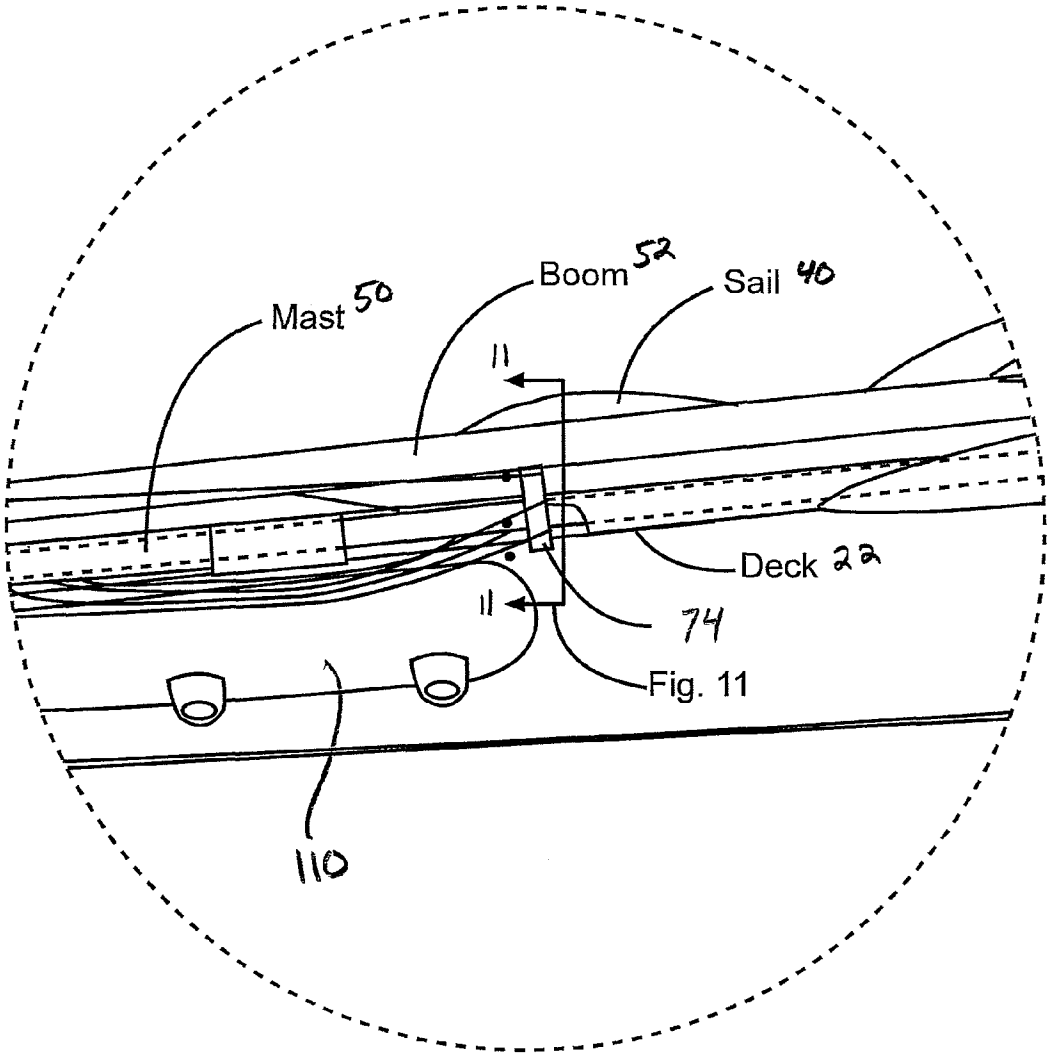
FIG. 10 is a side elevational view of a portion of the kayak and sail assembly, wherein the sail is in a fully released and retracted position.

The illustrated embodiment of the intersection ring 74 shown in FIGS. 11 and 12 can be formed from a circular flat metal plate having a central hole 111 for receiving the ferrule 76. The intersection ring 74 may further include a flat surface 75 formed in the circumferential edge of the intersection ring. When the sail assembly 12 is lowered to a released and retracted position placed on top of the deck 22, as shown in FIGS. 3, 10, and 11, the flat surface 75 may be positioned adjacent the deck 22 to help prevent puncturing or scratching of the deck 22. The flat surface 75 also permits the mast 50 and/or boom 52 to be positioned closer to the deck 22, thereby helping reduce bending of the mast 50 and/or the boom 52 at the region adjacent the intersection ring 74. The flat surface 75 also helps in lowering the sail 40 and mast 50 closer to the deck 22 when retracted.

As shown in FIG. 1, the sail assembly 12 may further include a rigging line commonly referred to as a boom yang line 112. The boom yang line 112 is provided to apply a downward force on the boom 52 when pulled by the sailor to control the shape of the sail 40. The boom yang line 112 may connected to the boom 52 at a pad eye 113 or any other suitable connection method. The pad eye 113 (or other connection) is mounted along a desired point along the length of the boom 52. From the pad eye 113, an upper portion 115 of the boom yang line 112 is directed in a forward and downward direction to a pulley 114. The pulley 114 is preferably located at position which is close to the bottom end of the mast 50 where the mast 50 connects with the deck 22. However, the pulley 114 can be located at any suitable position. From the pulley 114, the boom yang line 112 is directed rearwardly to a cleat 116 located adjacent the opening 28 so that a free end 117 of the boom yang line 112 can be easily handled by the sailor when needed. The free end 117 is grasped by the sailor to control the boom 52. For example, pulling on the boom yang line 112 generally causes the boom 52 to lower in a direction towards the deck 22 of the kayak 10. The cleat 116 may be used to maintain the boom yang line 112 in a desired position or tension.

The bottom end of the mast 50 is connected to the deck 22 of the kayak 10 via a coupling assembly, indicated generally and schematically at 120 in FIG. 1. The coupling assembly 120 permits the mast 50 and sail 40 to pivot rearwardly from an upright position. The coupling assembly 120 may also permit the mast 50 to move in a port and starboard direction as well as in front and aft direction. The coupling assembly 120 can be any suitable mechanism that permits such movement.

Figure 5:
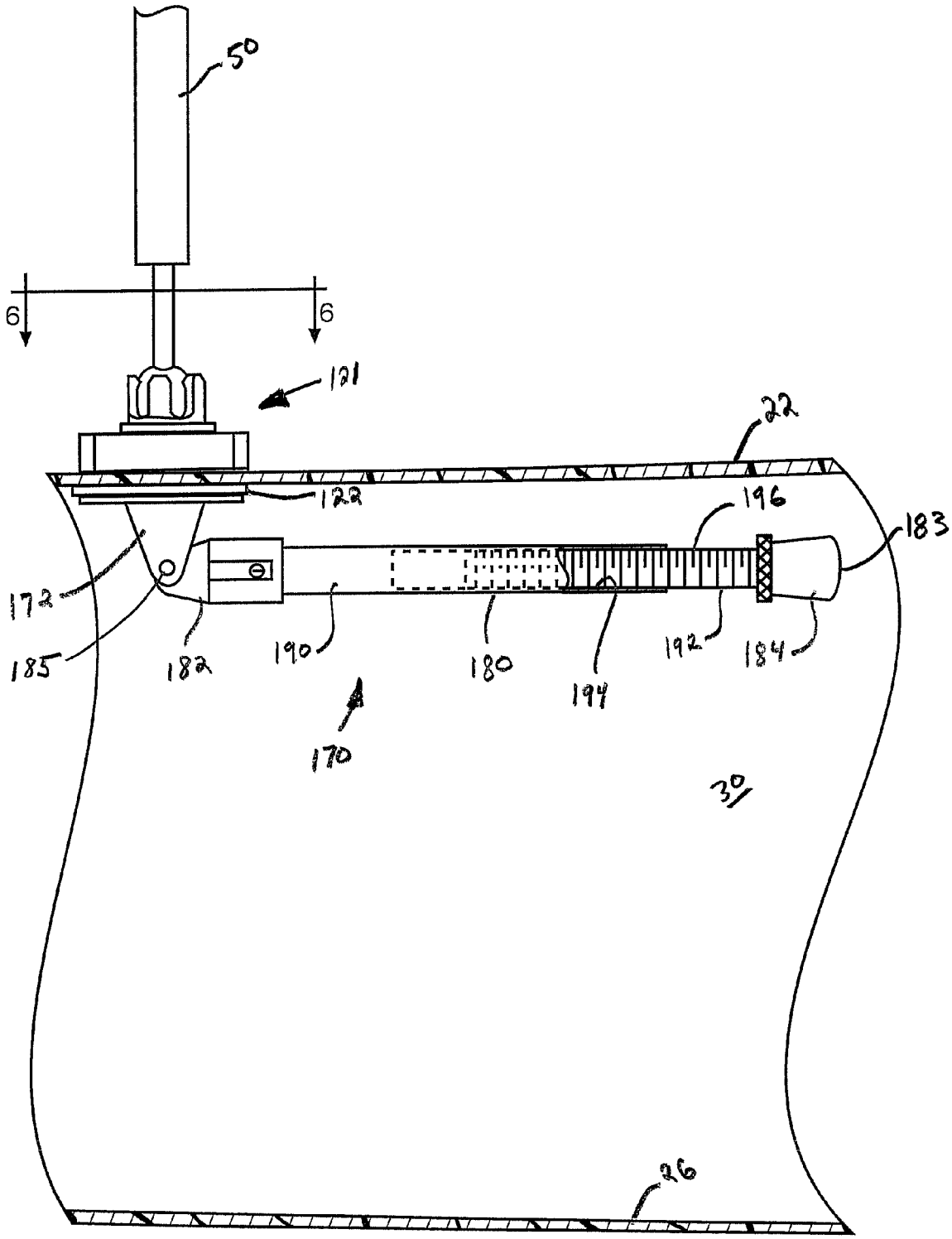
FIG. 5 is a partial cross-sectional view similar to FIG. 4, wherein the support member of the mast step is shown in a retracted position.
Figure 6:
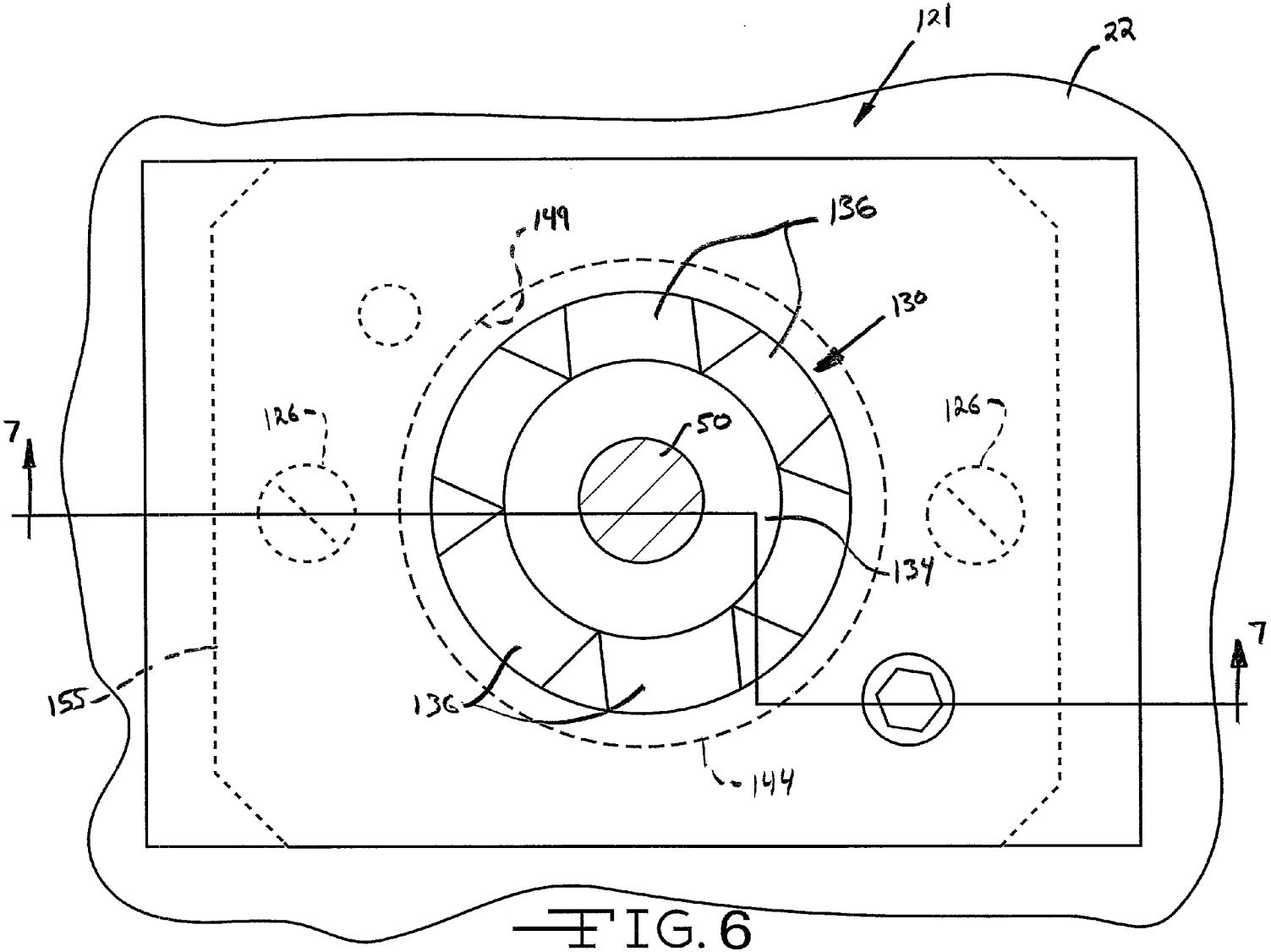
FIG. 6 is a partial cross-sectional view through the mast taken along lines 6-6 of FIG. 5 showing a top plan view of a first embodiment of a coupling assembly.
Figure 7:
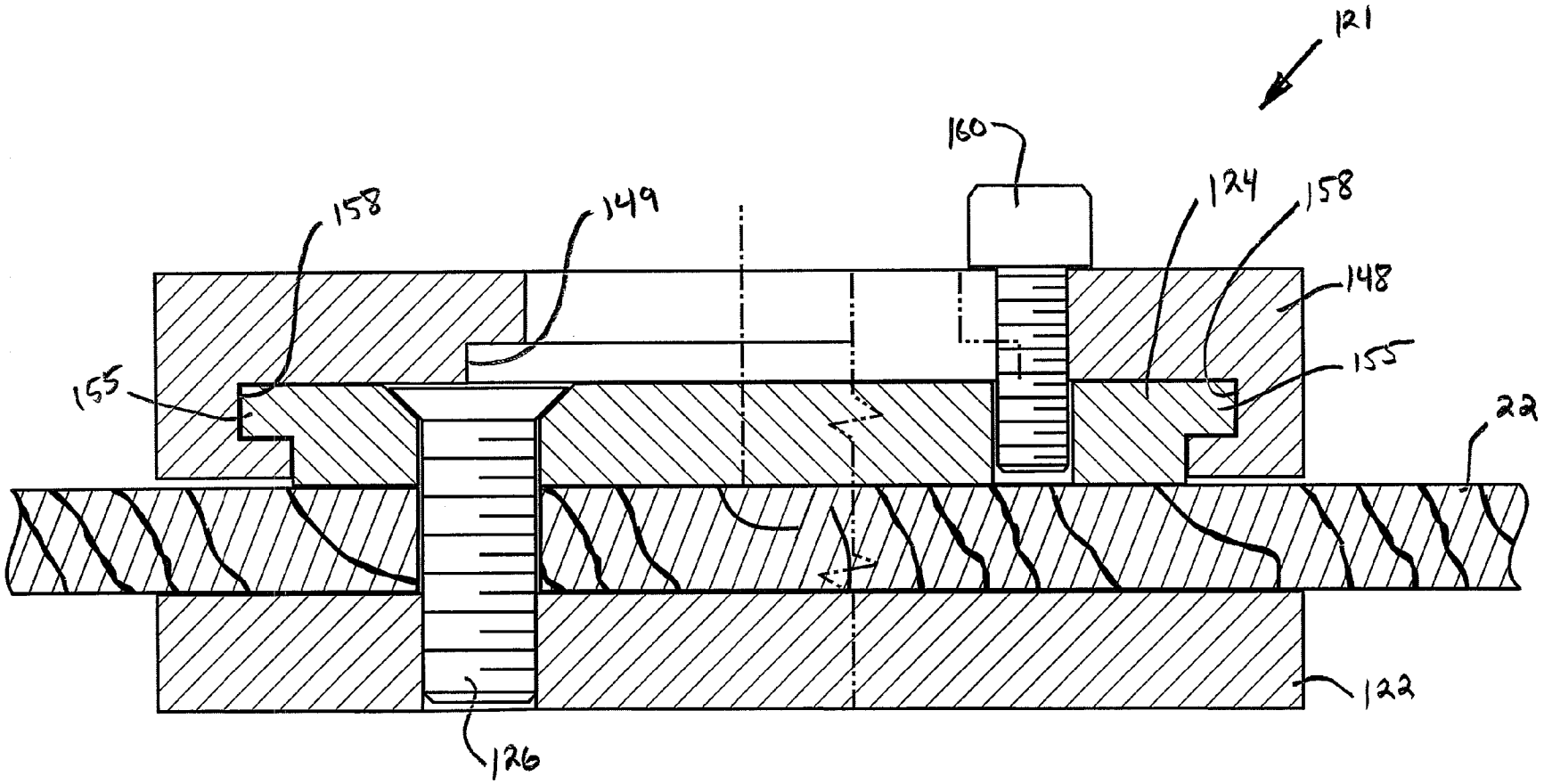
FIG. 7 is a cross-sectional view through a portion of the coupling assembly taken along lines 7-7 in FIG. 6.
Figure 8:
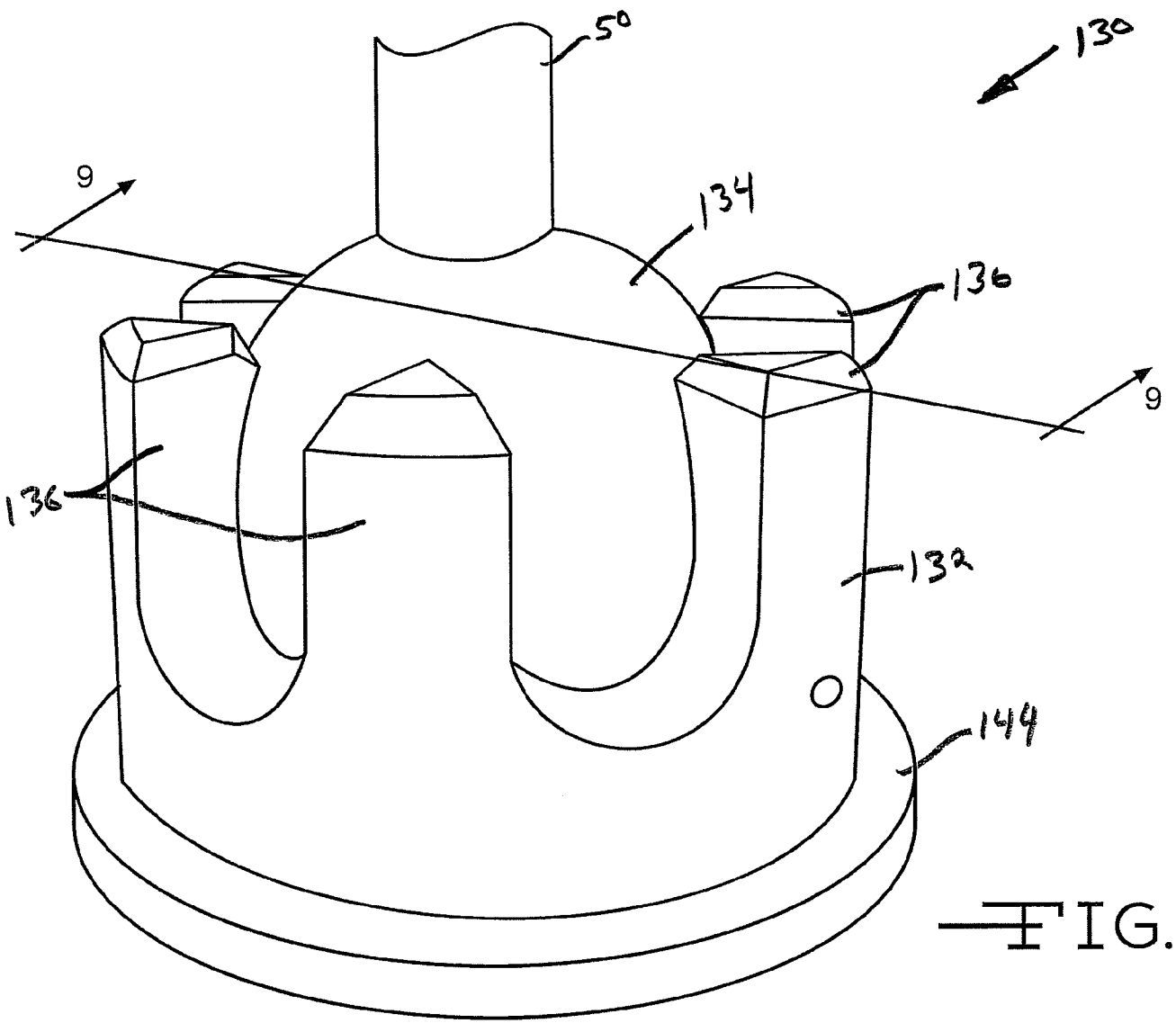
FIG. 8 is a perspective view of a portion of the ball and socket assembly of the coupling assembly of FIG. 6.
Figure 9:
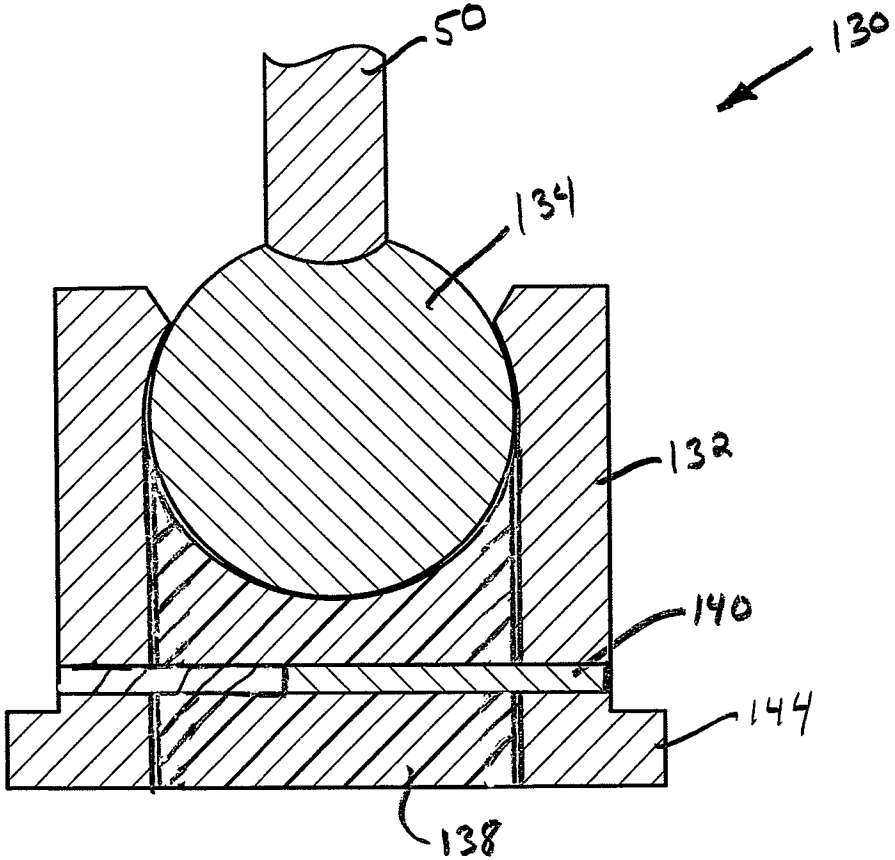
FIG. 9 is a cross-sectional view through the ball and socket assembly taken along lines 9-9 in FIG. 8.

There is illustrated in FIGS. 5 though 8, a first embodiment of a coupling assembly 121 which may be used for the coupling assembly 120. Referring to FIGS. 6 and 7, the coupling assembly 121 includes an under deck plate 122 and a track plate 124. The under deck plate 122 and the track plate 124 are bolted together by bolts 126 such that the deck 22 is disposed between the plates 122 and 124. It is anticipated that the plates 122 and 124 are installed onto the deck 22 such that they are permanent fixtures on the kayak 10. The plates 122 and 124 function as a mounting member for securing the coupling assembly 121 to the deck 22. The sail assembly 12 includes a removable attachment assembly defined by a ball and socket assembly 130. As shown in FIGS. 8 and 9, the ball and socket assembly 130 includes a multi-armed socket member 132 that traps a spherical member or ball 134 under a plurality of arms 136. There are six arms 136 shown in FIGS. 6 and 8. As shown in FIG. 9, a bottom plug 138 is removably attached to the socket member 132 via one or more set screws 140 or any other suitable fastener to capture the ball 134. The ball 134 is attached to the bottom end of the mast 50. The socket assembly 132 includes an outwardly extending annular flange 144. As shown in FIG. 7, a mast bracket 148 includes a circular recess or slot 149 that receives the flange 144 of the socket member 132. Note that the socket assembly 130 is not shown in FIG. 7. The mast bracket 148 is then attached onto the track plate 124 by first sliding the mast bracket 148 over a pair of outer flanges 155 formed in the track plate 124 which are received in a pair of corresponding slots 158 formed in the mast bracket 148. A bolt 160 fixedly secures the mast bracket 148 onto the track plate 124, thereby securing the sail assembly to the deck 22 of the kayak 10. The components of the coupling assembly 120 can be made of any suitable materials such as metal or plastic.

Figure 13:
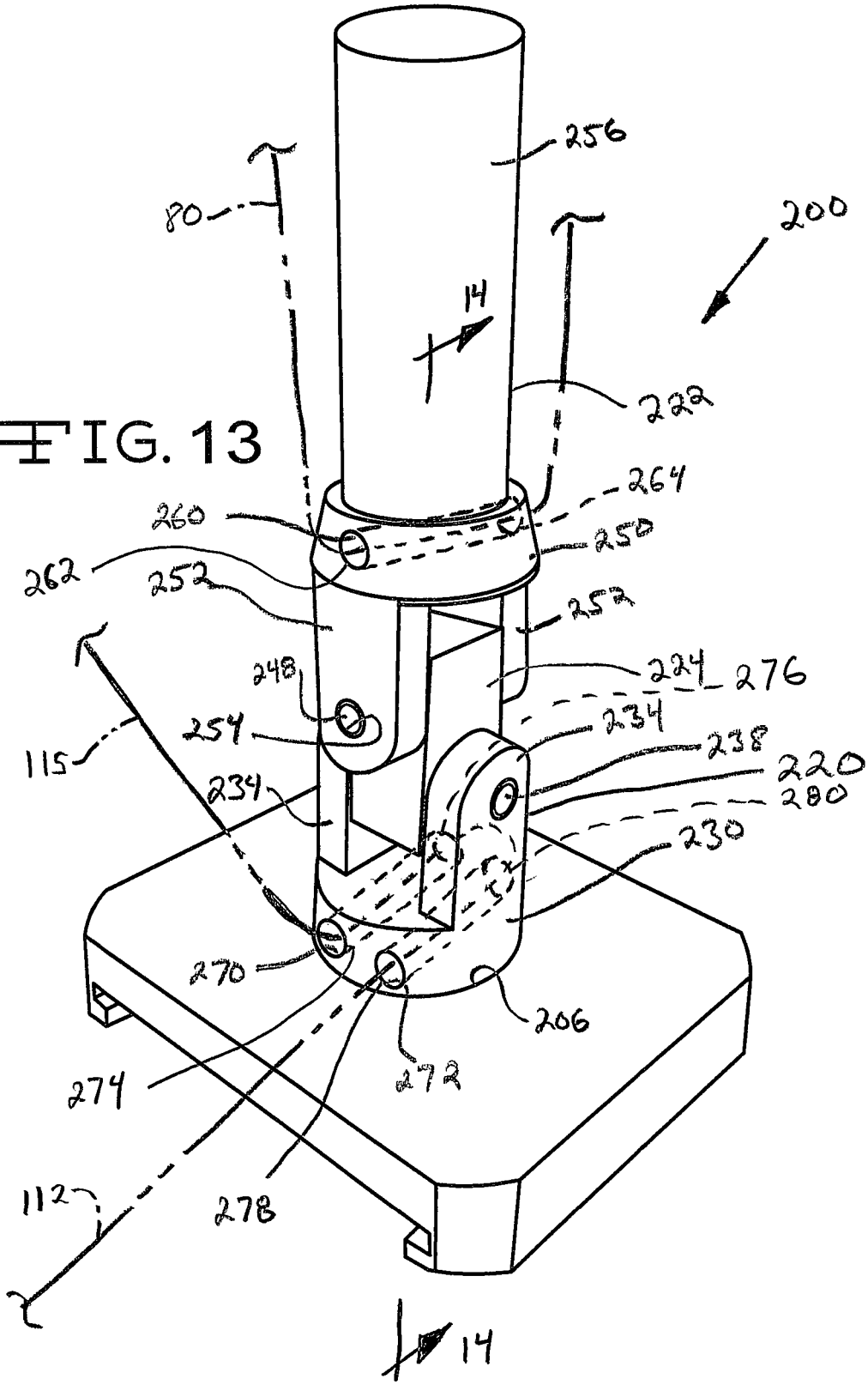
FIG. 13 is an aft perspective view of a second embodiment of a coupling assembly.
Figure 14:
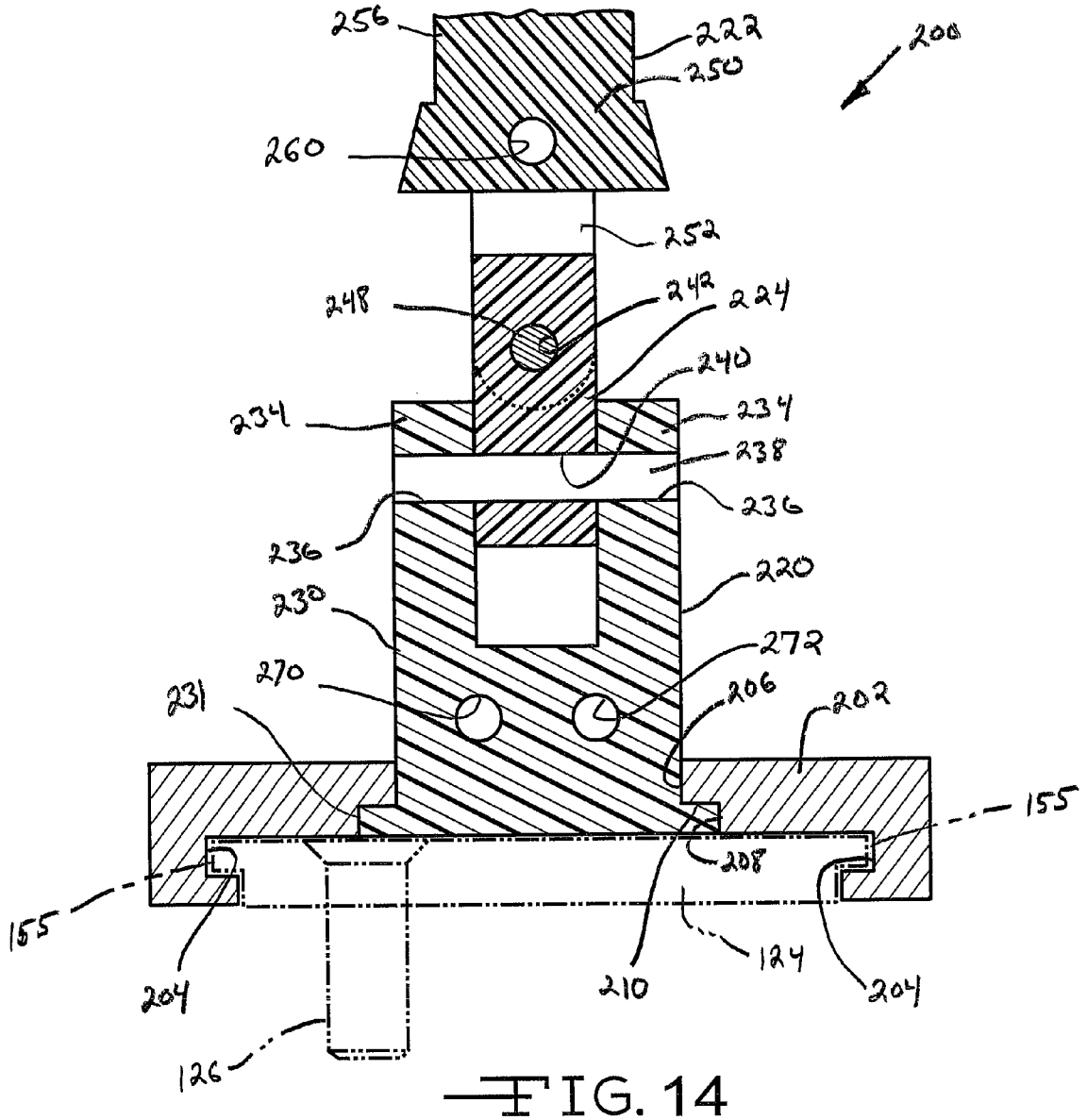
FIG. 14 is a cross-sectional view of the second embodiment of the coupling assembly taken along lines 14-14 in FIG. 13.

There is illustrated in FIGS. 13 and 14 a second embodiment of a coupling assembly 200 which may be used for the coupling assembly 120. The coupling assembly 200 is generally in the form of a universal joint, as will be described below. Similar to the coupling assembly 121, the coupling assembly 200 includes a sliding mast bracket 202. The mast bracket 202 can be attached to the permanently attached track plate, indicated by broken lines 124. The mast bracket 202 includes a pair of slots 204 that receive the outer flanges 155 of the track plate 124. The mast bracket 202 includes a first circular opening 206 and a circular recess 208 having a larger diameter than the first circular opening 206 to define a shoulder 210.

The coupling assembly 200 further includes a lower yoke 220, an upper yoke 222, and a cross member 224 which are pivotally connected together to form a universal joint. The lower yoke 220 has a body 230 having a circular base 231 formed at the bottom of the body 230. The base 231 is rotatably disposed in the recess 208 of the mast bracket 202. The shoulder 210 of the mast bracket 202 and the circular base 231 cooperate to secure the lower yoke 220 to the mast bracket 202 while permitting rotational movement of the lower yoke 220 relative to the mast bracket 202. The lower yoke 220 includes a pair of spaced apart yoke arms 234 extending upwardly from the body 230. The yoke arms 234 include pivot holes 236 formed therethrough which receive a pivot pin 238. The cross member 224 includes a lower pivot hole 240 which receives the pivot pin 238, thereby providing a pivoting mounting arrangement of the cross member 224 relative to the lower yoke 220. The cross member 224 additionally includes an upper pivot hole 242 for receiving a pivot pin 248. The upper pivot hole 242 extends at a right angle relative to the lower pivot hole 240. The upper yoke 222 includes a body 250 and a pair of yoke arms 252 extending downwardly therefrom. The yoke arms 252 include pivot holes 254 formed therein which receive the pivot pin 248, thereby providing a pivoting mounting arrangement of the cross member 224 relative to the upper yoke 222. The upper yoke 22 further includes an extension 256 for connection with the lower end of the mast 50. For example, if the mast 50 where a tubular member, the extension 256 can be sized to be inserted within the tubular mast 50 and adhered or otherwise attached thereto.

The coupling assembly 200 optionally includes a plurality of holes or apertures formed therein which may function as a fairlead such that rigging lines can be inserted through respective holes and then directed to desired locations. For example, as shown in FIGS. 13 and 14, the body 250 of the upper yoke 222 includes a through hole 260 formed therein. The hole 260 is generally straight and defines an aft opening 262 and a forward opening 264 formed in a sidewall of the body 250. It is desirable for the coupling assembly 200 to be positioned such that the hole 260 extends in the fore and aft direction relative the kayak 10. In this configuration, the forestay, represented as broken lines 80 in FIG. 13, can be inserted through the hole 260 instead of running the forestay around the pulley 88 of FIG. 1. Thus, the pulley 88 can be eliminated and the forestay 80 instead is directed from the intersection ring 74 through the hole 260 and then to the eyelet 86 for attachment to the tack 87 of the sail 40.

The lower yoke 220 may be formed with a first hole 270 and a second hole 272. The first and second holes 270 and 272 may be generally straight and parallel with respect to one another. The first and second holes 270 and 272 may also extend in the fore and aft direction. The first hole 270 defines an aft opening 274 and a forward opening 276. The second hole 272 defines an aft opening 278 and a forward opening 280. The boom yang line, represented by broken lines 112 in FIG. 13, may be inserted through the holes 270 and 272, thereby eliminating the need for the pulley 114 in FIG. 1. In this configuration, the upper portion 115 of the boom yang line 112 is directed from the pad eye 113, through the first hole 270, then looped through the second hole 272 towards the aft position, as shown in FIG. 13. The use of the holes 260, 270, and 272 as fairleads provides for a cost effective solution and enables the elimination of relative expensive pulleys 88 and 114. The location of the holes 270 and 272 being approximately centered and adjacent the mounting location of the mast 50 to the deck 22 of the kayak 10 is an ideal location for routing of the boom yang 112. It is preferred that the tightening of the boom yang 112 applies a downward force on the boom 52 with minimal side load forces acting on the boom 52. Thus, it is preferred that the upper portion 115 of the boom yang line 112 between the pad eye 113 and the hole 270 generally lie within a plane defined by the mast 50 and the boom 52. Thus, even if the boom 52 extends at an extreme port or starboard side of the kayak 10, pulling on the boom yang line 112 will not impart a side load on the boom 52. In comparison, the pulley 114 of FIG. 1 may not lie in the plane defined by the mast 50 and the boom 52 when the boom is in an extreme port or starboard position, such that the tension within the boom yang line 112 will impart a side load on the boom 52 causing the boom 52 to move towards the centerline of the kayak 10.

Referring to FIGS. 4 and 5, the sail assembly 10 may further include an optional mast step assembly, indicated generally at 170. The mast step assembly 170 helps transfer the load of the sail assembly 12 acting on the deck 22 of the kayak 10 to the hull 26 of the kayak 10, thereby helping to reduce the load acting solely on the deck 22. The highest load is a downwardly directed force component acting on the coupling assembly 120 by a combination of forces from the weight of the sail assembly 12, the wind forces acting on the sail 40 transmitted through the mast 50, and the tensile forces from the various rigging lines of the sail assembly 12. By transferring the load acting at the coupling assembly 120, the mast step assembly 170 helps to allow a relatively high tension load on the forestay 80 without crushing or damaging the deck 22.

As shown in FIGS. 4 and 5, the mast step assembly 170 includes a bracket 172 extending downwardly from the under deck plate 122. Alternatively, the under deck plate 122 and the bracket 172 may be integrally formed together. The mast step assembly 170 includes a support member 180 that generally extends between the deck 22 and the hull 26. The support member 180 illustrated in FIGS. 4 and 5 is in the form of an elongated rod and has a first end 182 that is pivotally attached to the bracket 172 at a pivot 185. A second end 183 of the support member 180 engages the hull 26. The support member 180 may be moved from a deployed position, as shown in FIG. 4, to a retracted position, as shown in FIG. 5, such as when the sail assembly 12 is not attached to the kayak 10 or is not required. When in the retracted position, the support member 180 is out of the way so the interior of the kayak 10 can be easily loaded. The support member 180 may be kept in its retracted position via the frictional engagement between the bracket 172 and the first end 182 of the support member 180. Alternatively, the support member 180 may be formed within one or more joints (not shown) to facilitate folding or moving the support member 180 between its deployed and retracted positions. Although the support member 180 is shown and described as an elongated rod, the support member 180 may have any suitable shape or configuration such as a plate or box-like structure which is capable of transmitting at least some of the forces acting the deck 22 to the hull 26. In yet another alternate embodiment, the support member 180 may be removably mounted at its first end 182 with the bracket 172 instead of being pivotally attached thereto. Thus, the support member 180 may still be moved out of the way when not needed, such as during loading of the interior of the kayak 10.

The second end 183 of the support member 180 may include an elastomeric end member 184 to promote a frictional engagement with the hull 26 of the kayak 10. Alternatively, the mast step assembly 170 could include a latching assembly (not shown) to more securely attach the second end 183 of the support member 180 onto the hull 26 of the kayak 10. The support member 180 may also be configured to be adjustable in length for accommodating different kayaks 10 or watercraft or to change the frictional engagement of the elastomeric end member 184 against the hull 26 of the kayak 10. For example, the support member 180 may include an upper rod 190 which is threadably engaged with a lower rod 192. The upper rod 190 includes internal threads 194 which threadably engage with external threads 196 formed in the lower rod 192. Rotation of the lower rod 192 relative to the upper rod 190 causes the overall length of the support member 180 to increase or decrease depending on the direction of rotation of the lower rod 192. Instead of configuring the support member 180 with an adjustable length, the support member 180 could be a relatively long rod or tube which can be cut to size for the particular kayak that the sail assembly 12 is mounted on.

Figure 15:
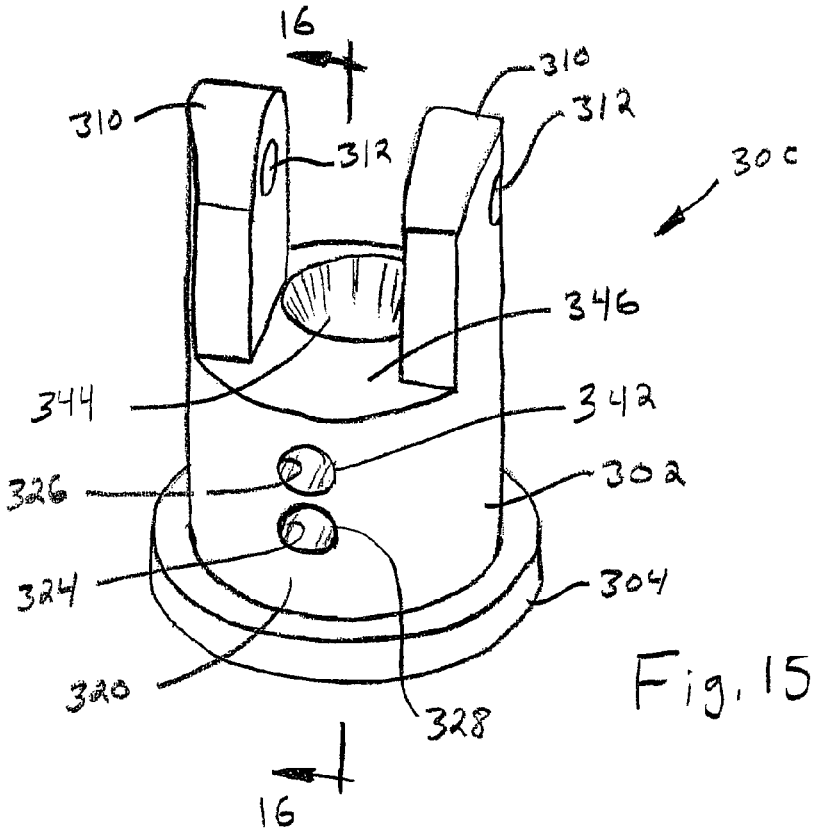
FIG. 15 is a front perspective view of second embodiment of a lower yoke for a coupling assembly.
Figure 16:
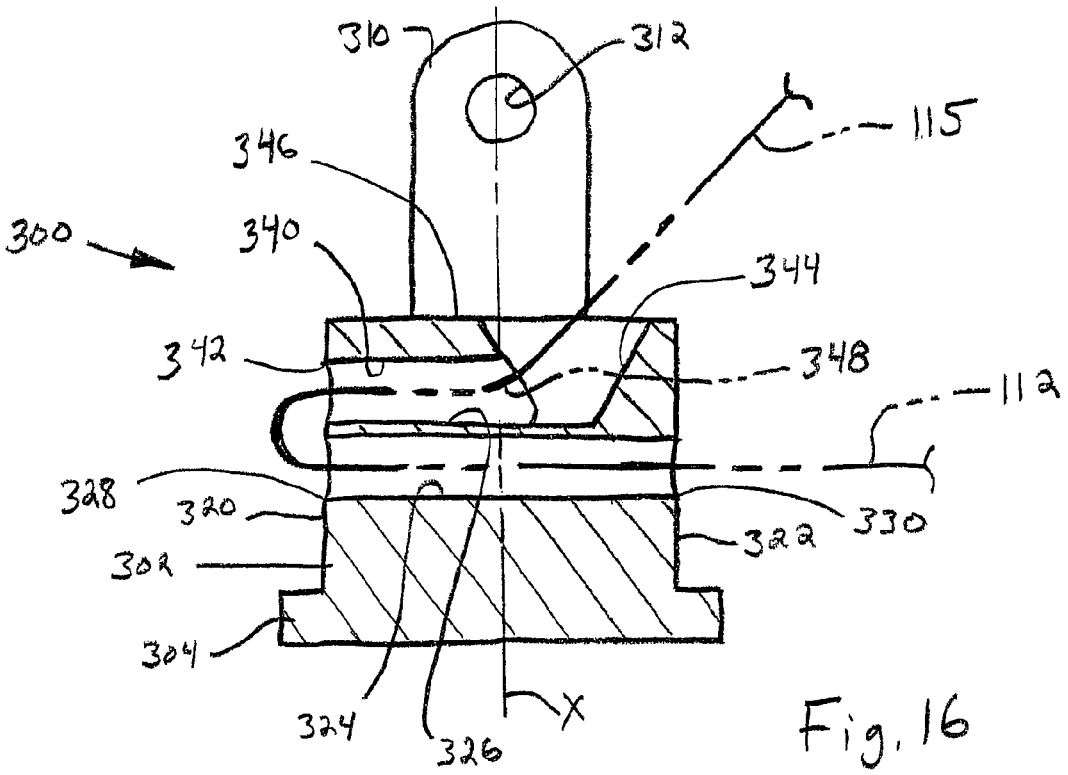
FIG. 16 is a cross-sectional view of the lower yoke taken along lines 16-16 of FIG. 16.

There is illustrated in FIGS. 15 and 16 an alternate embodiment of a lower yoke, indicated generally at 300. The lower yoke 300 is similar in structure and function as the lower yoke 220 but has differently shaped fairlead holes, as will be explained below. The lower yoke 300 includes a cylindrical body 302 having a circular base 304 which may be rotatably disposed in the recess 208 of the mast bracket 202. The lower yoke 300 also includes a pair of upwardly extending yoke arms 310 with pivot holes 312 formed therein for receiving pivot pins (not shown) for pivotally mounting a cross member (not shown).

The body 302 of the lower yoke 300 defines a front side 320 and an aft side 322. The body 302 includes a lower hole 324 and an upper passageway 326 formed through the body 302. The upper passageway 326 is positioned above the lower hole 324. The lower hole 324 and the upper passageway 326 define fairleads for the boom yang line 112. The lower hole 324 may be formed as a straight passageway extending between a front opening 328 at the front side 320 of the body 302 to an aft opening 330 at the aft side 322. The upper passageway 326 includes a straight hole 340 extending in a fore and aft direction and defines a front opening 342. The straight hole 340 communicates with a frustoconical opening 344 formed in an upper surface 346 of the body 302. The frustoconical opening 344 may be formed along an axis X of the lower yoke 300 or may be slightly offset therefrom towards the aft side 322 of the body 302, as shown in FIGS. 15 and 16. In this configuration, the upper portion 115 of the boom yang line 112 is directed into the upper passageway 326 and bends at a bend 348 generally at the location where the straight hole 240 and the frustoconical opening 244 communicate with one another. The bend 348 is preferably located along the axis X of the lower yoke 300 which also coincides with the axis of the mast 50. The bend 348 also lies in a plane defined by the mast 50 and the boom 52. In this configuration, even if the boom 52 extends at an extreme port or starboard side of the kayak 10, side loads acting the boom 52 are eliminated or minimized when tensile loads are applied to the boom yang line 112.

The larger size frustoconical opening 344 helps to accommodate the angle of the upper portion 115 of the boom yang line 112, as well as accommodate minor changes in direction of the boom yang line 112. However, it should be understood that the frustoconical opening 244 need not be frustoconical in shape but can have any suitable shape which accommodates the geometry of the boom yang line 112.

Figure 17:
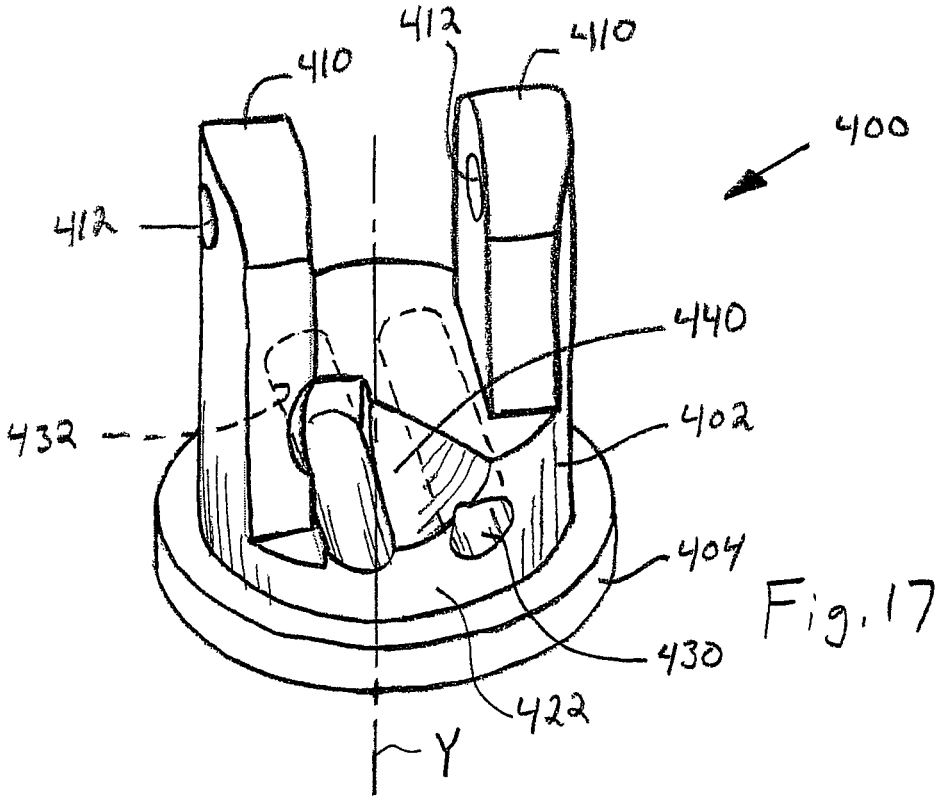
FIG. 17 is an aft perspective view of a third embodiment of a lower yoke for a coupling assembly.

There is illustrated in FIG. 17 an alternate embodiment of a lower yoke, indicated generally at 400. The lower yoke 400 is similar in structure and function as the lower yokes 220 and 300 but has differently shaped fairlead holes, as will be explained below. The lower yoke 400 includes a cylindrical body 402 having a circular base 404 which may be rotatably disposed in the recess 208 of the mast bracket 202. The lower yoke 300 also includes a pair of upwardly extending yoke arms 410 with pivot holes 412 formed therein for receiving pivot pins (not shown) for pivotally mounting a cross member (not shown). The body 402 of the lower yoke 400 defines a front side and an aft side 422, viewable in FIG. 17. The body 402 includes a first hole 430 and a second hole 432. First and second holes 430 and 432 extend in a fore and aft direction and are parallel to one another. A trough 440 is formed in a planar upper surface 442 of the body 402. The trough 440 is formed at the aft side 422 of the body 402 and communicates with the second hole 432. The trough 440 can be any suitable depression or groove formed in the upper surface 442 to accommodate the angle of the upper portion 115 of the boom yang line 112 (not illustrated in FIG. 17). Note that neither of the first and second holes 430 and 432 extends through an axis Y of the lower yoke 400 but are slightly offset therefrom. Thus, the trough 440 is formed at an angle relative to the fore and aft direction to accommodate the upper portion 115 of the boom yang line 112.

Figure 18:
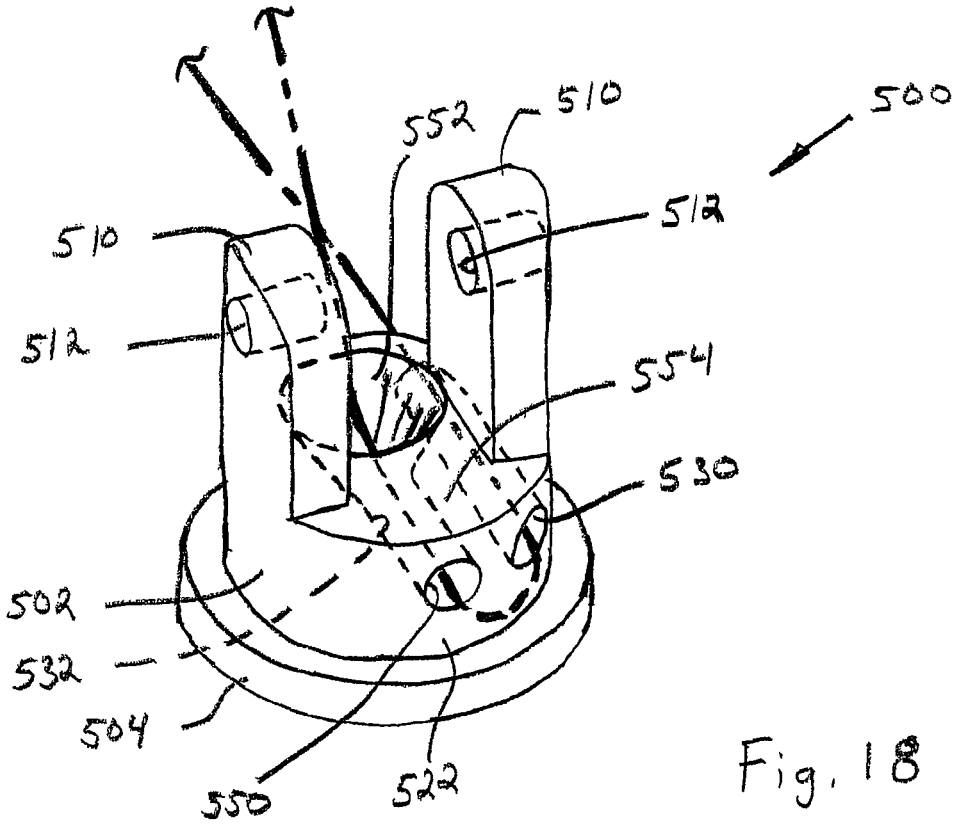
FIG. 18 is affront perspective view of a fourth embodiment of a lower yoke for a coupling assembly.

There is illustrated in FIG. 18 an alternate embodiment of a lower yoke, indicated generally at 500. The lower yoke 500 is similar in structure and function as the lower yokes 220, 300 and 400 but has differently shaped fairlead holes, as will be explained below. The lower yoke 500 includes a cylindrical body 502 having a circular base 504 which may be rotatably disposed in the recess 208 of the mast bracket 202. The lower yoke 500 also includes a pair of upwardly extending yoke arms 510 with pivot holes 512 formed therein for receiving pivot pins (not shown) for pivotally mounting a cross member (not shown). The body 502 of the lower yoke 500 defines a front side 522, viewable in FIG. 17, and an aft side. The body 502 includes a side hole 530 which extends in a fore and aft direction and is preferably straight. The side hole 530 is offset from a centerline plane of the lower yoke 500 which extends along the fore and aft directions. The centerline plane coincides with the plane defined by the mast 50 and the boom 52. A passageway 532 includes a straight hole 550 extending in a fore and aft direction and extends through the plane centerline plane of the lower yoke 500. A frustoconical opening 552 is formed in a planar upper surface 554 of the body 502. The frustoconical opening 552 communicates with the straight hole 550. In a similar manner as the frustoconical opening 344 of the lower yoke 300, the frustoconical opening 552 accommodates the upper portion 115 of the boom yang line 112.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A mast assembly for a sailing vessel comprising:

a first tubular portion defining an interior and an end;

a second tubular portion defining an interior and an end;

a ferrule having a first end disposed within said interior of said first tubular portion, and a second end disposed within said interior of said second tubular portion; and an intersection ring disposed over said ferrule and positioned between said ends of said first and second tubular portions, wherein said intersection ring includes a plurality of apertures formed therein for receiving rigging lines.

2. The assembly of claim 1, wherein said ferrule is permanently attached to only one of said first and second tubular portions.

3. The assembly of claim 1, wherein said ferrule is one of a rod and a tube.

4. The assembly of claim 3, wherein said intersection ring has a generally circular shape with a flatten surface formed at one region along the circumference of said intersection ring.

5. The assembly of claim 1 further including a sail mounted on both of said first and second tubular portions.

6. The assembly of claim 5 further including a rigging line having first and second ends and an intermediate portion disposed between said first and second ends, and wherein said first end is attached to a tack of said sail, and wherein said intermediate portion extends through one of the plurality of apertures of said intersection ring.

7. A mast coupling assembly for pivotally attaching a mast to a sailing vessel comprising:

a mounting member adapted to be attached to a deck of a sailing vessel; and a universal joint assembly including:

a first yoke having a body and a pair of spaced apart yoke arms extending from said body, wherein said body is rotatably attached to said mounting member, a second yoke having a body and a pair of spaced apart yoke arms extending outwardly from said body of said second yoke, wherein said body of said second yoke is adapted to be connected to an end of a mast; and a cross member pivotally attached to said yoke arms of said first and second yokes, wherein one of said bodies of said first and second yokes includes an aperture formed therethrough adapted to receive a rigging line.

8. The assembly of claim 7, wherein said body of said first yoke includes first and second apertures formed therethrough for receiving rigging lines.

9. The assembly of claim 8, wherein said body of said second yoke includes a third aperture formed therethrough for receiving rigging lines.

10. A sail assembly for a sailing vessel comprising:

a sail defining a tack;

a mast attached to said sail, wherein said mast includes a first end a second end;

a coupling assembly pivotally attached to the second end of said mast, wherein said coupling assembly is adapted to be mounted on a deck of a sailing vessel;

a boom attached to said mast at a connection point, wherein said connection point is adjacent said tack of said sail;

a first fairlead located between said connection point and said coupling assembly;

a second fairlead located on said mast between said first end of said mast and said connection point; and a single flexible rigging line having a first end attached to said tack of said sail, and wherein said line extends from said tack to said first fairlead, and from said first fairlead to said second fairlead.

11. The assembly of claim 10 further including a third fairlead adapted to be attached to a bow of the sailing vessel, wherein said line extends from said second fairlead to said third fairlead.

12. The assembly of claim 11 further including a cleat adapted to be attached to a mid portion of said sailing vessel, wherein said line extends from said pulley to said cleat.

13. A mast step assembly for a sailing vessel having a deck and a hull comprising:

a mounting bracket adapted to be attached to an underside of a deck; and a support member having a first end pivotally attached to said mounting bracket, said support member having a second end adapted to engage a hull of the sailing vessel, wherein said support member is movable between a retracted position such that said second end is not engaged with the hull, and a deployed position such that said second end is engageable with the hull for transferring a portion of a load acting on the deck to the hull.

14. The assembly of claim 13, wherein said first end of said support member is pivotally attached to said mounting bracket.

15. The assembly of claim 12, wherein said first end of said support member is removably attached to said mounting bracket.

16. The assembly of claim 13, wherein said support member is an elongated rod.

17. The assembly of claim 13, wherein said second end of said support member includes an elastomeric member for frictionally engaging with the hull.

18. The assembly of claim 13, wherein said support member is configured such that a length between said first and second ends can be increased or decreased.

19. The assembly of claim 18, wherein said support member includes a first rod having internal threads, and a second rod having external threads engaged with said internal threads.

20. The assembly of claim 1, wherein said intersection ring is sandwiched between said ends of said first and second tubular portions.

* * * * *